US009010573B2

(12) United States Patent
Larsson et al.

(10) Patent No.: US 9,010,573 B2
(45) Date of Patent: Apr. 21, 2015

(54) NOZZLE BOOT ARRANGEMENT, A NOZZLE BOOT MODULE, A FUEL DISPENSING UNIT, AND A METHOD OF MANUFACTURING SUCH A NOZZLE BOOT ARRANGEMENT

(75) Inventors: Bengt Ingemar Larsson, Tingarod (SE); Hanna Helgesson, Malmo (SE)

(73) Assignee: Wayne Fueling Systems Sweden AB, Malmo (SE)

( * ) Notice: Subject to any disclaimer, the term of this patent is extended or adjusted under 35 U.S.C. 154(b) by 0 days.

(21) Appl. No.: 13/809,401

(22) PCT Filed: Jul. 9, 2010

(86) PCT No.: PCT/EP2010/059924

§ 371 (c)(1),
(2), (4) Date: Jan. 9, 2013

(87) PCT Pub. No.: WO2012/003886

PCT Pub. Date: Jan. 12, 2012

(65) Prior Publication Data

US 2013/0112706 A1 May 9, 2013

(51) Int. Cl.

| | |
|---|---|
| ***B67D 7/12*** | (2010.01) |
| ***B67D 7/84*** | (2010.01) |
| ***B67D 7/06*** | (2010.01) |
| ***B67D 7/42*** | (2010.01) |

(52) U.S. Cl.
CPC .. *B67D 7/84* (2013.01); *B67D 7/06* (2013.01); *B67D 7/42* (2013.01)

(58) Field of Classification Search
CPC ..... B67D 7/84; B67D 7/06; A47G 19/00; A62C 35/00
USPC ..... 141/279, 382; 137/355.16–355.19; 222/71–75, 153.03–153.04, 179.5, 222/180, 320, 470–475, 538, 566
See application file for complete search history.

(56) References Cited

U.S. PATENT DOCUMENTS

| | | | | |
|---|---|---|---|---|
| 2,150,025 | A * | 3/1939 | Cook, Jr. et al. | 222/36 |
| 2,364,138 | A * | 12/1944 | Grise | 222/34 |
| 2,577,859 | A * | 12/1951 | Schirmer | 222/74 |
| 3,118,570 | A * | 1/1964 | Zieg | 222/74 |

(Continued)

FOREIGN PATENT DOCUMENTS

AU 198065376 6/1981

OTHER PUBLICATIONS

PCT, International Preliminary Report on Patentability, International Application No. PCT/EP2010/059924; International Filing Date: Jul. 9, 2010, 8 pages.

*Primary Examiner* — Paul R Durand
*Assistant Examiner* — Andrew P Bainbridge

(57) ABSTRACT

There is provided in one aspect a nozzle boot arrangement for supporting a nozzle of a fuel dispensing unit, the nozzle including a spout and a base portion including a grip. The arrangement includes a nozzle boot including means for supporting the nozzle at the base portion thereof, and a section for receiving at least a portion of the spout. The arrangement also includes a stopper provided at said receiving section and formed separately from said nozzle boot. The stopper is arranged to cooperate with the spout to prevent the nozzle from falling about from the nozzle boot arrangement by rotation of the nozzle about said supporting means. According to further aspects, there is provided a fuel dispensing unit, a nozzle boot module and method of manufacturing a nozzle boot arrangement.

20 Claims, 5 Drawing Sheets

(56) References Cited

U.S. PATENT DOCUMENTS 5,083,846 A * 1/1992 Day et al. ..... 312/321.5
5,110,010 A * 5/1992 Smith ..... 222/75
7,975,878 B2 * 7/2011 Wemmert ..... 222/74
2008/0006652 A1 * 1/2008 Wemmert ..... 222/74

* cited by examiner

NOZZLE BOOT ARRANGEMENT, A NOZZLE BOOT MODULE, A FUEL DISPENSING UNIT, AND A METHOD OF MANUFACTURING SUCH A NOZZLE BOOT ARRANGEMENT

TECHNICAL FIELD

The present inventive concept relates to a nozzle boot arrangement for a fuel dispensing unit, a fuel dispensing unit comprising a nozzle boot arrangement, a nozzle boot module, a fuel dispensing unit comprising a nozzle boot module, as well as a method of manufacturing a nozzle boot arrangement.

BACKGROUND

A fuel dispensing unit used for filling the fuel tank of a motor vehicle with fuel is a complex device containing a vast number of parts. As a result, the costs associated with the production and mounting of fuel dispensing units is a constant issue in this field.

One of the parts of a fuel dispensing unit is the nozzle boot. The nozzle boot is arranged to support a nozzle of the fuel dispensing unit when it is not in use. The nozzle should be securely attached to the nozzle boot so that it does not fall out therefrom. This is traditionally achieved through for example a hook arrangement in the lower part of the nozzle boot and a cavity in the upper part of the nozzle boot in which a tip portion of a spout of the nozzle is to be inserted. The nozzle boot is formed from a single piece of material such that a front tab or stopper is formed at an upper part of the nozzle boot with the cavity extending behind the stopper. The cavity and the stopper are so formed that, when the nozzle is placed in the nozzle boot, the stopper engages with the spout to prevent the nozzle from falling out from the nozzle boot by rotation of the nozzle about the hook arrangement.

Since nozzles come in a variety of different designs, each nozzle boot needs to be manufactured to match a specific nozzle design. It is both time consuming and costly to manufacture nozzle boots in a plurality of different designs in this manner.

SUMMARY OF THE INVENTION

It is an object of the present inventive concept to provide an improvement over the prior art. More particularly, it is an object of the present inventive concept to provide a nozzle boot arrangement which enables manufacturing of fuel dispensing units in a cheaper and more efficient manner.

According to a first aspect of the inventive concept, there is provided a nozzle boot arrangement for supporting a nozzle of a fuel dispensing unit, the nozzle comprising a spout and a base portion including a grip, the arrangement comprising: a nozzle boot including supporting means for supporting the nozzle at the base portion thereof, and a receiving section for receiving at least a portion of the spout, and a stopper provided at said receiving section and formed separately from said nozzle boot, wherein the stopper is arranged to cooperate with the spout to prevent the nozzle from falling out from the nozzle boot arrangement by rotation of the nozzle about said supporting means.

By the inventive provision of a separately formed stopper, a nozzle boot arrangement is provided which may be manufactured in a cheaper and more efficient manner than prior art nozzle boots. The nozzle boot and its receiving section may thus be conveniently manufactured without the stopper obstructing as in prior art nozzle boots. This in turn enables convenient manufacture of the nozzle boot and its receiving section in a single piece, e.g. by a moulding process. This enables simplified and rationalized mass production of nozzle boots.

Without the stopper obstructing, it further becomes possible to manufacture the nozzle boot such that its receiving section may receive nozzles of a plurality of different designs and sizes with simple tools and in a cost effective manner. Such a nozzle boot may be used with nozzles of many different sizes. This enables a substantial cost reduction for manufacturing fuel dispensing units.

The nozzle boot arrangement may, if needed, also be conveniently adapted or optimized for a specific nozzle design by appropriate design of the stopper. This may for example be useful if a nozzle at a fuel dispensing unit is replaced with a nozzle having a different design.

The stopper may for example form part of an outer wall portion of the arrangement. This simplifies manufacturing of the fuel dispensing unit in that no additional parts are needed for providing the stopper.

According to one embodiment the nozzle boot arrangement further comprises detecting means for detecting presence of the nozzle at the nozzle boot. This enables convenient detection of presence of the nozzle wherein a pump of the fuel dispensing unit may be activated and deactivated accordingly.

The means for detecting may be arranged at the supporting means. Alternatively, the detecting means may be arranged at the receiving section. More specifically, the detecting means may be arranged at the stopper.

According to a second aspect of the present inventive concept, there is provided a nozzle boot module attachable to a fuel dispensing unit, the module comprising a module top and a nozzle boot arrangement in accordance with the previous aspect and embodiments wherein the arrangement is arranged below the module top. The advantages and details discussed above in connection with the nozzle boot arrangement apply correspondingly to the inventive nozzle boot module. Additionally, by this modular design the handling of nozzle boots and assembling of nozzle boots with a fuel dispensing unit is facilitated.

The module may be attachable to a supporting column of the fuel dispensing unit. The module may for example comprise a channel extending through the module top, the channel being arranged to receive at least a portion of the supporting column. This enables a reliable and strong attachment of the nozzle boot module to the fuel dispensing unit. It further enables the module to be assembled with the fuel dispensing unit as a single component.

According to one embodiment the stopper of the nozzle boot arrangement forms part of an outer wall of the nozzle boot module. Thus, no separate part is needed for providing the stopper.

According to one embodiment the stopper forms part of the module top. A stopper may hence be provided at the nozzle boot simply by bringing the module top and the nozzle boot together.

The module top may comprise a top section and a first side section, wherein the stopper forms part of the first side section.

The module top may further comprise a second side section and the nozzle boot module may further comprise a second nozzle boot arrangement in accordance with the previous aspect and embodiments, wherein a stopper of the second nozzle boot arrangement may form part of the second side section. A fuel dispensing unit may hence be provided with two nozzle boot arrangements by a single nozzle boot module wherein no separate parts are needed for providing the stoppers.

According to a third aspect of the present inventive concept, there is provided a fuel dispensing unit comprising a nozzle boot arrangement as set out in the above paragraphs. The stopper may for example form part of an outer wall of the fuel dispensing unit. The advantages and details discussed above in connection with the nozzle boot arrangement apply correspondingly to the inventive fuel dispensing unit.

According to a fourth aspect of the present inventive concept, there is provided a fuel dispensing unit comprising a nozzle boot module as set out in the above paragraphs. The nozzle boot module may for example be arranged on a column of the fuel dispensing unit. More specifically, the module may comprise a channel extending through the module top, the channel being arranged to receive at least a portion of the supporting column. The advantages and details discussed above in connection with the nozzle boot module apply correspondingly to the inventive fuel dispensing unit.

According to a fifth aspect, there is provided a method of manufacturing a nozzle boot arrangement for supporting a nozzle of a fuel dispensing unit, said nozzle comprising a spout and a base portion including a handle, the method comprising: moulding a nozzle boot body including a receiving section for receiving at least a portion of the spout, providing the body with means for supporting the nozzle at the base portion thereof, forming a stopper separately from the nozzle boot body, and assembling the nozzle boot arrangement from the nozzle boot body and the stopper by arranging the stopper at the receiving section such that, when the nozzle arrangement is in use and supports a nozzle, the stopper cooperates with the spout in such a manner that fall out of the nozzle from the nozzle boot arrangement by rotation of the nozzle about said supporting means is prevented.

The inventive manufacturing method enables forming of the nozzle boot body and its receiving section in a single piece. This enables simplified and rationalized mass production of nozzle boots.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF THE PREFERRED EMBODIMENT(S)

Figure 1:
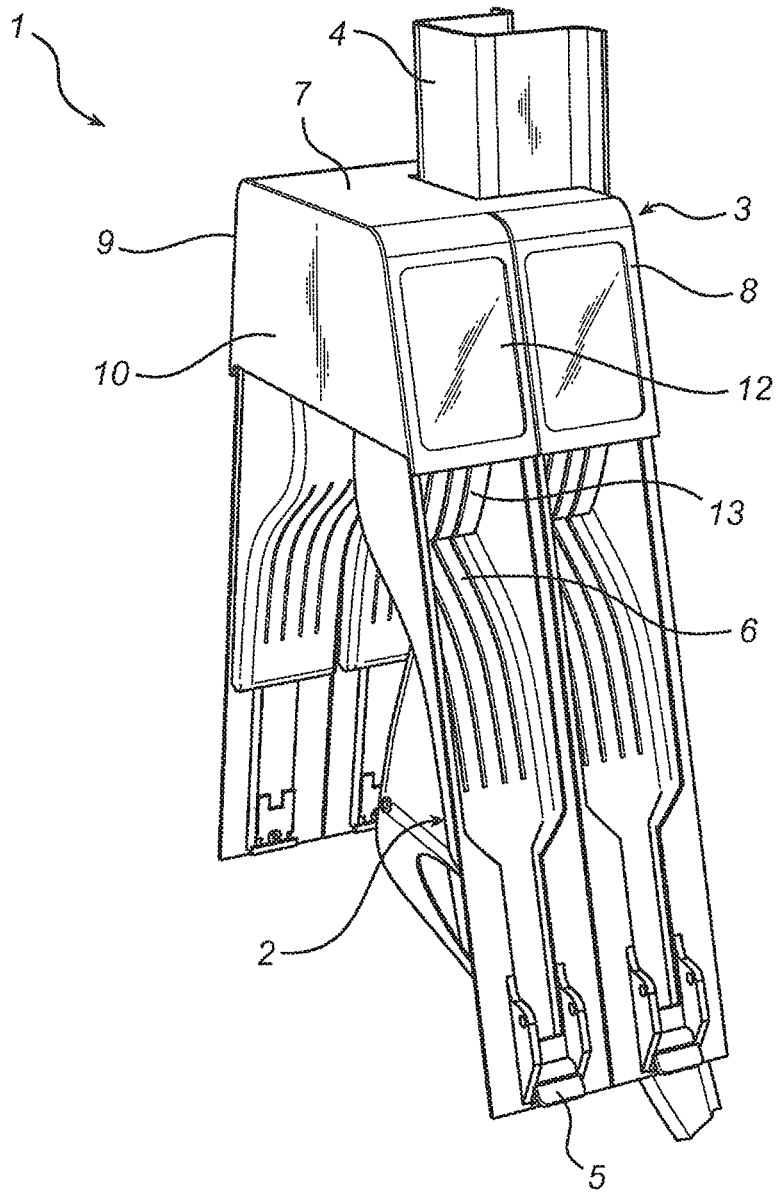
FIG. 1 is a perspective view of an embodiment of a nozzle boot module and a supporting column.

FIG. 1 illustrates an embodiment of nozzle boot module 1 in accordance with one aspect of the present inventive concept. The nozzle boot module 1 comprises four nozzle boots 2 arranged in a pair wise manner and on opposite sides of the module 1. The module 1 further comprises a module top 3. The module 1 may further comprise side sections arranged below the module top 3 and possibly also a bottom section arranged below the nozzle boots 2 (not shown in FIGS. 1-2 for increasing the clarity of the drawings).

According to the present embodiment, the module 1 comprises four nozzle boots 2. However, according to alternative embodiments a nozzle boot module may comprise fewer nozzle boots (e.g. 1 or 2) or more nozzle boots (e.g. 6, 7 or 8 etc).

Figure 2:
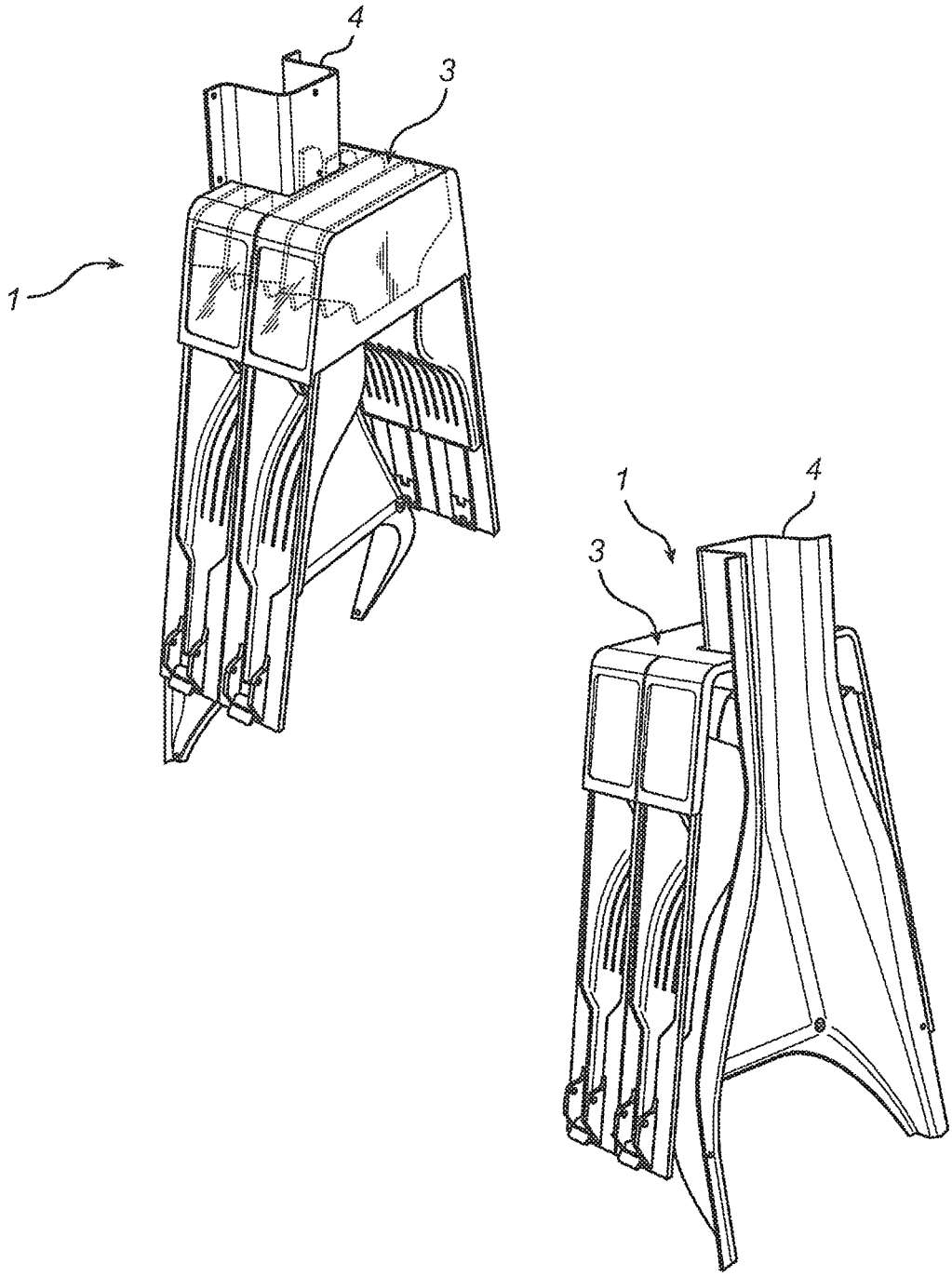
FIG. 2 includes two further perspective views of the nozzle boot module and the supporting column.

The nozzle boot module 1 is attached to a supporting column 4 of a fuel dispensing unit. The nozzle boot module 1 comprises a channel extending through the module top 3 for receiving a portion of the supporting column 4. The supporting column 4 may present a portion having an upwardly tapering cross section wherein the module 1 may be arranged on the column 4 in a hanging manner. This may be seen more clearly in FIG. 2 illustrating the nozzle boot module 1 from two further directions.

According to alternative embodiments, a nozzle boot module 1 may be attached to a column of a fuel dispensing unit in other ways. For example, a column may be provided with a shelf on which the nozzle boot module 1 may rest. A nozzle boot module may also be attached to other parts of a fuel dispensing unit than a column, e.g. a wall section of the unit.

Figure 4:
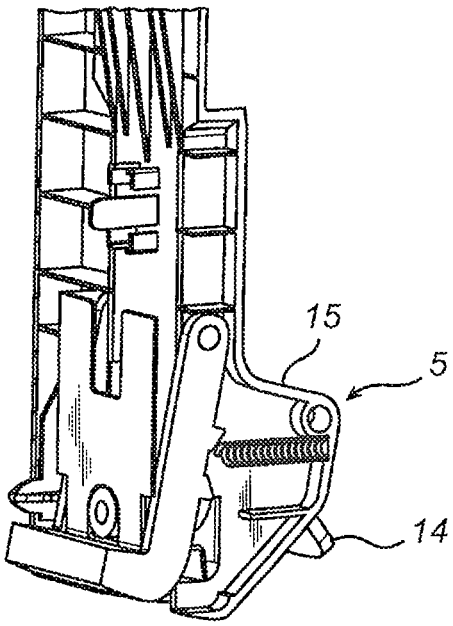
FIG. 4 illustrates details of a supporting means of the nozzle boot module.

Returning to FIG. 1, each nozzle boot 2 is arranged to support a nozzle comprising a spout and a base portion including a grip. For this purpose, the nozzle boot 2 comprises supporting means 5 for supporting the nozzle at the base portion thereof. The supporting means 5, an example of which is shown in detail in FIG. 4, are provided at a lower part of the nozzle boot 2. The supporting means 5 comprises a flap 14 and a pair of vertically extending side surfaces 15 for supporting the nozzle sideways.

Returning to FIG. 1, the nozzle boot 2 extends from the lower part to an upper part of the nozzle boot 2. At the upper part, the nozzle boot 2 comprises a receiving section 6 for receiving at least a tip portion of the spout (i.e. the outer end portion of the spout) of the nozzle. The section 6 thus forms a cavity or hollow in the outer surface of the module 1.

The body of the nozzle boot 2, i.e. the nozzle boot 2 without the flap 14, may be formed separately from the further parts of the module 1. The body may e.g. be formed from a plurality of suitably formed segments or in a single piece, e.g. in a moulding process.

The module top 3 comprises a horizontally oriented top section 7. The module top 3 further comprises a first side section 8 and a second side section 9. The first and the second side sections 8, 9 may be integrally formed with the top section 7 or otherwise attached thereto e.g. by snap locks, by screws, by gluing, by welding etc. Each one of the top and side section 7, 8, 9 may also be manufactured in one or more separate parts and brought together during assembly of the module 1. The first and the second side sections 8, 9 extend in a mutually converging manner towards the top section 7.

The module top 3 further comprises support structures extending between the first and the second side sections 8, 9 as indicated in the upper part of FIG. 2 in order to increase the rigidity and durability of the module top 3 and in turn the module 1.

The module top 3 further comprises a third side section 10. The third side section 10 extends in a tapering manner between the first and the second side sections 8, 9 towards the top section 7. The module top 3 may further comprise a fourth side section (not shown in FIGS. 1-2 for increasing the clarity of the drawings) arranged opposite the third side section 10. In embodiments wherein the nozzle boot module comprises the above-mentioned support column channel, the channel may divide the fourth side section into two portions. The third side section 10 and, if present, the fourth side section may be integrally formed with the top section 7 or otherwise attached thereto e.g. by snap locks, by screws, by gluing, by welding etc.

The module top 3 is arranged on top of the nozzle boots 2. The module top 3 may be attached to the nozzle boots 2 by appropriate attachment means such as snap locks, screws, by gluing, by welding etc. to thereby enable a self-contained nozzle boot module which may be conveniently handled.

A lower portion of the first and second side sections 8, 9 extend in front of the receiving sections 6 of the nozzle boots 2. Thereby the lower portions of the first and the second side sections 8, 9 each form a stopper 12 for each nozzle boot 2. This is clearly seen in FIG. 3 which illustrates a cross section of the nozzle boot module 1 wherein the lower portion of the first side section 8 extends in front of the receiving section 6 thereby forming the stopper 12.

The combination of the nozzle boot 2 and the stopper 12 forms a nozzle boot arrangement wherein, when the nozzle is positioned in the nozzle boot 2, the stopper 12 will engage with the spout and thereby prevent the nozzle from rotating about the supporting means 5 and fall out from the nozzle boot arrangement 2.

According to the first embodiment, the stopper 12 of each nozzle boot arrangement is integrally formed with the side sections 8, 9. Each side section 8, 9 forms an outer wall of the nozzle boot module 1 and each nozzle boot arrangement. Each stopper 12 thus forms part of an outer wall portion of the nozzle boot module 1 or the nozzle boot arrangement.

By appropriate design of the receiving section 6 and length of the stopper 12, a nozzle boot arrangement for supporting nozzles of various different sizes may be obtained.

Figure 3:
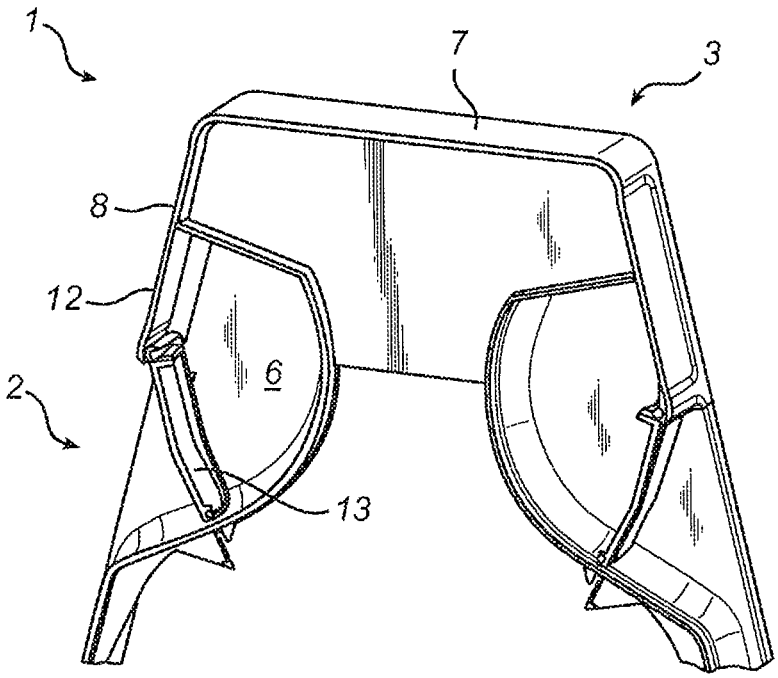
FIG. 3 shows a cross section of the nozzle boot module.

Each nozzle boot arrangement may further comprise detecting means 13 for detecting presence of a nozzle at the nozzle boot. The detecting means 13 may communicate with a controller of the fuel dispensing unit wherein a pump of the fuel dispensing unit may be deactivated in response to the detecting means 13 detecting presence of the nozzle and activated in response to the detecting means 13 not detecting presence of the nozzle. As shown in FIGS. 1 and 3, the detecting means 13 may be arranged at the receiving section 6. The detecting means 13 may e.g. comprise a flap, pivotally connected to the section 6 or, alternatively, to a lower portion of the stopper 12. In case the flap is pivotally connected to the stopper 12, the stopper 12 may cooperate with the spout of the nozzle via the flap to prevent the nozzle from rotating and thereby falling out as described above. When the spout is received in the receiving section 6, the flap will be actuated by the spout. The detecting means 13 may further comprise a magnetic or electrical switch for sensing the actuation of the flap and transmitting a detection signal to the fuel dispensing unit controller.

The detecting means 13 may also be arranged at the supporting means 5 as illustrated in FIG. 4. In response to the nozzle being removed from supporting means 5 and the flap 14, the clamp or link returns to its unloaded position wherein a magnet is disconnected from the sensor, thus indicating that the nozzle has been removed from the nozzle boot.

These implementations of the detecting means 13 are purely by way of example and other implementations are also possible. For example, the detecting means 13 may include optical or magnetic sensors provided at the receiving section 6 for detecting presence of the nozzle.

Figure 6:
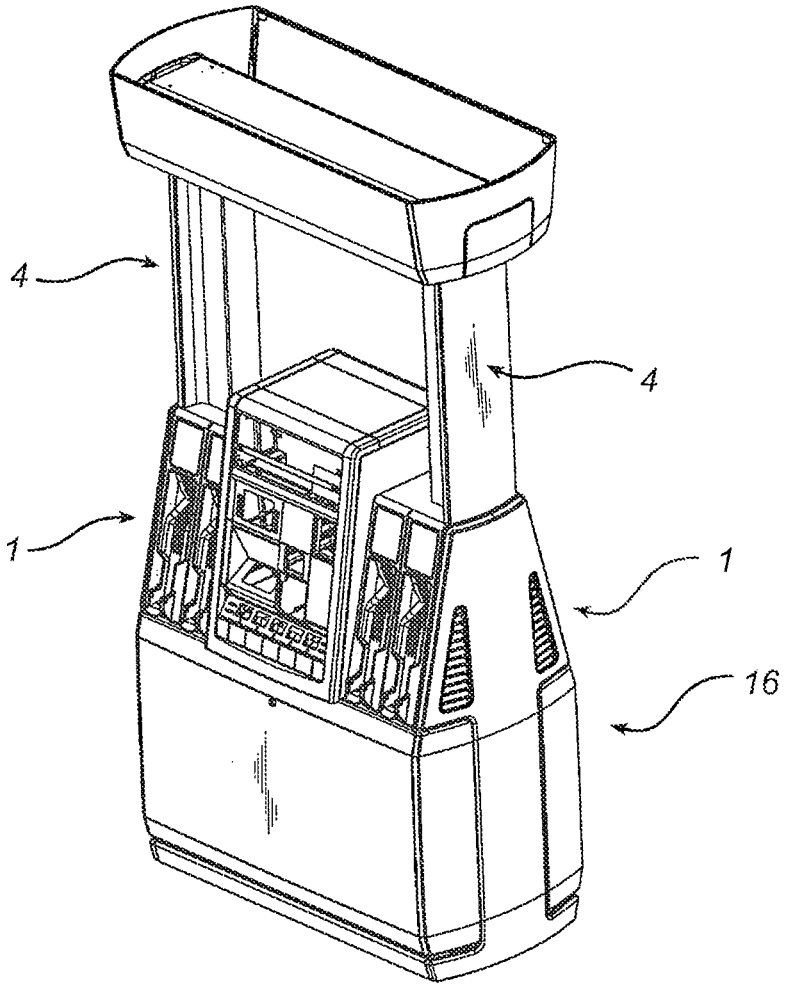
FIG. 6 illustrates a fuel dispensing unit comprising two nozzle boot modules.

FIG. 6 illustrates a fuel dispensing unit 16 comprising two nozzle boot modules 1, each module 1 attached to a respective supporting column 4.

In the above, the nozzle boot arrangement has been disclosed in connection with the nozzle boot module 1 and the fuel dispensing unit 16. However, the nozzle boot arrangement need not be included in a nozzle boot module but may also be used in non-modular applications. Hence, according to a further aspect of the present inventive concept there is provided a fuel dispensing unit comprising a nozzle boot provided on a side section of the fuel dispensing unit. According to this aspect, a stopper for preventing the nozzle from falling out from the nozzle boot may form part of an outer wall on a side section of the fuel dispensing unit, the stopper and the nozzle boot together forming a nozzle boot arrangement.

According to a further aspect of the present inventive concept, there is provided a method of manufacturing a nozzle boot arrangement for supporting a nozzle of a fuel dispensing unit. An embodiment of such a manufacturing method will now be described with reference to FIG. 5. According to this embodiment, a nozzle boot body 20 is moulded, the body 20 including a section 6 for receiving at least a portion of the spout. The body 20 may be formed by injection moulding. The body 20 may be moulded in a single piece. Alternatively, the body 20 may be assembled from a plurality of separately moulded body portions. The body 20 may be formed in e.g. metal such as aluminum or in plastics.

The body 20 may be moulded with integral side portions 21, 22. Alternatively, the side portions 21, 22 may be separately formed and attached to the body 20 after moulding thereof. The body 20 may further be provided with means for supporting the nozzle at the base portion thereof, the means being similar to the means 5 described in connection with FIGS. 1-4.

The method further comprises forming a stopper 12 separately from the body 20. As discussed in connection with FIGS. 1-4, the stopper 12 may e.g. be formed as part of an outer wall of a fuel dispensing unit or a module top of a nozzle boot module.

Figure 5:
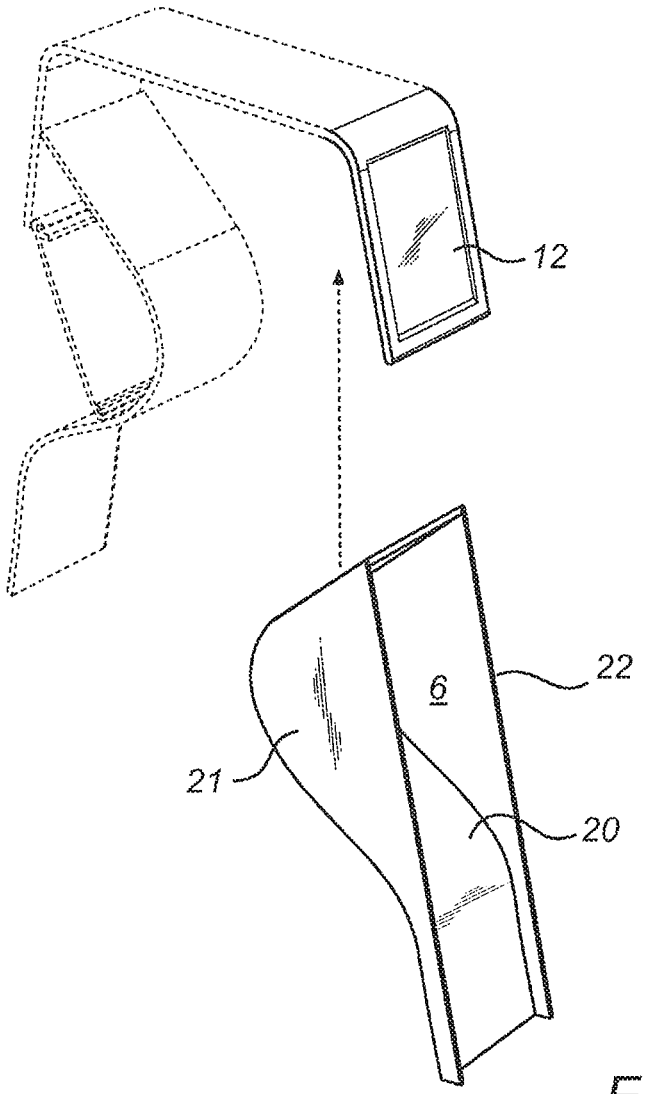
FIG. 5 schematically illustrates an embodiment of manufacturing of a nozzle boot arrangement.

As schematically illustrated in FIG. 5, the nozzle boot arrangement may then be assembled from the body 20 and the stopper 12 by arranging the stopper 12 at the receiving section 6 such that, when the nozzle boot arrangement is in use and supports a nozzle, the stopper 12 cooperates with the spout in such a manner that fall out of the nozzle from the nozzle boot arrangement by rotation of the nozzle about said supporting means is prevented.

In the above, the present inventive concept has mainly been described above with reference to a few embodiments. However, as is readily appreciated by a person skilled in the art, other embodiments than the ones disclosed above are equally possible within the scope of the invention, as defined by the appended claims.

The invention claimed is:

1. A nozzle boot arrangement for supporting first and second nozzles of a fuel dispensing unit, the arrangement comprising:

a first nozzle boot including first means for supporting the first nozzle at a first base portion of the first nozzle, and a first receiving section for receiving at least a portion of a first spout of the first nozzle, a second nozzle boot including second means for supporting the second nozzle at a second base portion of the second nozzle, and a second receiving section for receiving at least a portion of a second spout of the second nozzle, the second base portion including a second grip, and a stopper arranged to cooperate with the first spout to prevent the first nozzle from falling out from the nozzle boot arrangement by rotation of the first nozzle about the first supporting means, and arranged to cooperate with the second spout to prevent the second nozzle from falling out from the nozzle boot arrangement by rotation of the second nozzle about the second supporting means, wherein the stopper is formed separately from the first and second nozzle boots.

2. A nozzle boot arrangement according to claim 1, wherein the stopper forms part of an outer wall portion of the arrangement.

3. A nozzle boot arrangement according to claim 1, further comprising means for detecting presence of the nozzle at the nozzle boot.

4. A nozzle boot arrangement according to claim 3, wherein the means for detecting is arranged at the means for supporting.

5. A nozzle boot arrangement according to claim 3, wherein the means for detecting is arranged at the receiving section.

6. A nozzle boot arrangement according to claim 3, wherein the detecting means is arranged at the stopper.

7. A nozzle boot module attachable to a fuel dispensing unit, the module comprising:

a nozzle boot arrangement according to claim 1, the nozzle boot module being attachable to a supporting column of the fuel dispensing unit.

8. A nozzle boot module according to claim 7, wherein the nozzle boot module comprises a channel extending through the stopper, the channel being arranged to receive at least a portion of the supporting column.

9. A nozzle boot module according to claim 7, wherein the stopper forms part of an outer wall of the nozzle boot module.

10. A fuel dispensing unit comprising:

the nozzle boot arrangement according to claim 1.

11. A fuel dispensing unit according to claim 10, wherein the stopper forms part of an outer wall of the fuel dispensing unit.

12. A fuel dispensing unit comprising:

a nozzle boot module according to claim 7.

13. A fuel dispensing unit arrangement according to claim 12, wherein the nozzle boot module is arranged on the supporting column.

14. A method of manufacturing a nozzle boot arrangement according to claim 1, the method comprising:

moulding a nozzle boot body including the receiving section, providing the body with means for supporting the first nozzle at the first base portion thereof, forming the stopper separately from the nozzle boot body, and assembling the nozzle boot arrangement from the nozzle boot body and the stopper by arranging the stopper at the first receiving section, wherein when the nozzle boot arrangement is in use and supports the first nozzle, the stopper cooperates with the first spout to prevent fall out of the first nozzle from the nozzle boot arrangement by rotation of the first nozzle about the first supporting means.

15. A method according to claim 14, wherein the nozzle boot body is moulded in a single piece.

16. A fuel dispensing system, comprising:

a first nozzle boot including a first support configured to support a first base portion of a first nozzle, and the first nozzle boot including a first cavity configured to receive at least a portion of a first spout of the first nozzle, a second nozzle boot including a second support configured to support a second base portion of a second nozzle, and the second nozzle boot including a second cavity configured to receive at least a portion of a second spout of the second nozzle, a U-shaped stopper that is an independent and discrete element from the first and second nozzle boots, the stopper extending over an open portion of the first cavity and being configured to prevent the first spout from falling out of the first cavity by rotation of the first nozzle about the first support, and the stopper extending over an open portion of the second cavity and being configured to prevent the second spout from falling out of the second cavity by rotation of the second nozzle about the second support.

17. A nozzle boot arrangement comprising:

a first nozzle boot including a first support configured to support a first base portion of a first nozzle, and the first nozzle boot including a first cavity configured to receive at least a portion of a first spout of the first nozzle, the first base portion including a first grip, a second nozzle boot including a second support configured to support a second base portion of a second nozzle, and the second nozzle boot including a second cavity configured to receive at least a portion of a second spout of the second nozzle, the second base portion including a second grip, and a stopper extending in front of the first cavity and in front of the second cavity, the stopper being configured to cooperate with the first spout so as to prevent the first nozzle from falling out from the first cavity by rotation of the first nozzle about the first support, and the stopper being configured to cooperate with the second spout so as to prevent the second nozzle from falling out from the second cavity by rotation of the second nozzle about the second support, wherein the stopper is formed separately from the nozzle boot and from the second nozzle boot.

18. A nozzle boot arrangement according to claim 17, wherein the stopper is U-shaped.

19. A nozzle boot arrangement according to claim 17, wherein the first nozzle boot is positioned on one side of a fuel dispenser and the second nozzle boot is positioned on an opposite side of the fuel dispenser.

20. A nozzle boot arrangement according to claim 1, wherein the stopper is U-shaped.

* * * * *